US006761088B1

(12) United States Patent
Sasso

(10) Patent No.: US 6,761,088 B1
(45) Date of Patent: Jul. 13, 2004

(54) BOTTLE OPENER

(76) Inventor: Carl Sasso, 13102 NW. 11th St., Pembroke Pines, FL (US) 33028

( * ) Notice: Subject to any disclaimer, the term of this patent is extended or adjusted under 35 U.S.C. 154(b) by 0 days.

(21) Appl. No.: 09/939,046

(22) Filed: Aug. 24, 2001

(51) Int. Cl.[7] ..... B67B 7/16
(52) U.S. Cl. ..... 81/3.57; 81/3.55
(58) Field of Search ..... 81/3.4, 3.55, 3.57

(56) References Cited

U.S. PATENT DOCUMENTS

| | | | | | |
|---|---|---|---|---|---|
| D42,368 | S | * | 3/1912 | Mossberg | 81/3.55 |
| 4,805,238 | A | * | 2/1989 | Crafts | |
| 4,894,866 | A | * | 1/1990 | Walker | |
| 4,967,622 | A | * | 11/1990 | Phillips | |
| 5,133,233 | A | * | 7/1992 | Erwin | |
| 5,261,299 | A | * | 11/1993 | Kondos | |
| D407,283 | S | * | 3/1999 | Schwab | |
| 6,098,497 | A | * | 8/2000 | Larose | 81/3.4 |

FOREIGN PATENT DOCUMENTS

| | | | | |
|---|---|---|---|---|
| CH | 641423 | * | 2/1984 | 81/3.57 |
| DK | 570083 | * | 12/1939 | 81/3.57 |

* cited by examiner

*Primary Examiner*—James G. Smith

(57) ABSTRACT

A bottle opener for opening a bottle in an efficient manner. The bottle opener includes a substantially rigid panel having a first surface, a second surface, a third surface and a fourth surface wherein the first and second surfaces are opposite surfaces. The third and fourth surfaces have a length greater than a length of the first and second surfaces. The panel has a first portion, a middle portion and a second portion wherein the first portion is adjacent to the first surface and the second portion is adjacent to the second surface. The panel has a first opening therein positioned in the middle portion. The first opening has a generally rectangular shape. A bottle cap is positioned in the opening and the panel biased against the bottle cap to remove the bottle cap.

1 Claim, 2 Drawing Sheets

BOTTLE OPENER

BACKGROUND OF THE INVENTION

1. Field of the Invention

The present invention relates to bottle openers and more particularly pertains to a new bottle opener for opening a bottle in an efficient manner.

2. Description of the Prior Art

The use of bottle openers is known in the prior art. More specifically, bottle openers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,805,238; 5,133,233; 5,261,299; 4,894,866; 4,967,622; and Des. 407,283.

While these devices fulfill their respective, particular objectives and requirements, the aforementioned patents do not disclose a new bottle opener. The inventive device includes a substantially rigid panel having a first surface, a second surface, a third surface and a fourth surface wherein the first and second surfaces are opposite surfaces. The third and fourth surfaces have a length greater than a length of the first and second surfaces. The panel has a first portion, a middle portion and a second portion wherein the first portion is adjacent to the first surface and the second portion is adjacent to the second surface. The panel has a first opening therein positioned in the middle portion. The first opening has a generally rectangular shape. A bottle cap is positioned in the opening and the panel biased against the bottle cap to remove the bottle cap.

In these respects, the bottle opener according to the present invention substantially departs from the conventional concepts and designs of the prior art, and in so doing provides an apparatus primarily developed for the purpose of opening a bottle in an efficient manner.

SUMMARY OF THE INVENTION

In view of the foregoing disadvantages inherent in the known types of bottle openers now present in the prior art, the present invention provides a new bottle opener construction wherein the same can be utilized for opening a bottle in an efficient manner.

The general purpose of the present invention, which will be described subsequently in greater detail, is to provide a new bottle opener apparatus and method which has many of the advantages of the bottle openers mentioned heretofore and many novel features that result in a new bottle opener which is not anticipated, rendered obvious, suggested, or even implied by any of the prior art bottle openers, either alone or in any combination thereof.

To attain this, the present invention generally comprises a substantially rigid panel having a first surface, a second surface, a third surface and a fourth surface wherein the first and second surfaces are opposite surfaces. The third and fourth surfaces have a length greater than a length of the first and second surfaces. The panel has a first portion, a middle portion and a second portion wherein the first portion is adjacent to the first surface and the second portion is adjacent to the second surface. The panel has a first opening therein positioned in the middle portion. The first opening has a generally rectangular shape. A bottle cap is positioned in the opening and the panel biased against the bottle cap to remove the bottle cap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bottle opener apparatus and method which has many of the advantages of the bottle openers mentioned heretofore and many novel features that result in a new bottle opener which is not anticipated, rendered obvious, suggested, or even implied by any of the prior art bottle openers, either alone or in any combination thereof.

It is another object of the present invention to provide a new bottle opener which may be easily and efficiently manufactured and marketed.

It is a further object of the present invention to provide a new bottle opener which is of a durable and reliable construction.

An even further object of the present invention is to provide a new bottle opener which is susceptible of a low cost of manufacture with regard to both materials and labor, and which accordingly is then susceptible of low prices of sale to the consuming public, thereby making such bottle opener economically available to the buying public.

Still yet another object of the present invention is to provide a new bottle opener which provides in the apparatuses and methods, of the prior art some of the advantages thereof, while simultaneously overcoming some of the disadvantages normally associated therewith.

Still another object of the present invention is to provide a new bottle opener for opening a bottle in an efficient manner.

Yet another object of the present invention is to provide a new bottle opener which includes a substantially rigid panel having a first surface, a second surface, a third surface and a fourth surface wherein the first and second surfaces arc opposite surfaces. The third and fourth surfaces have a length greater than a length of the first and second surfaces. The panel has a first portion, a middle portion and a second portion wherein the first portion is adjacent to the first surface and the second portion is adjacent to the second surface. The panel has a first opening therein positioned in the middle portion. The first opening has a generally rectangular shape. A bottle cap is positioned in the opening and the panel biased against the bottle cap to remove the bottle cap.

Still yet another object of the present invention is to provide a new bottle opener that allows a user, such as a bartender, the ability to open up a plurality of bottles in a quick manner with little risk of injury.

Even still another object of the present invention is to provide a new bottle opener that has an adjustable strap for fitting many sized hands for allowing the user to use the leverage of their entire arm when opening a bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
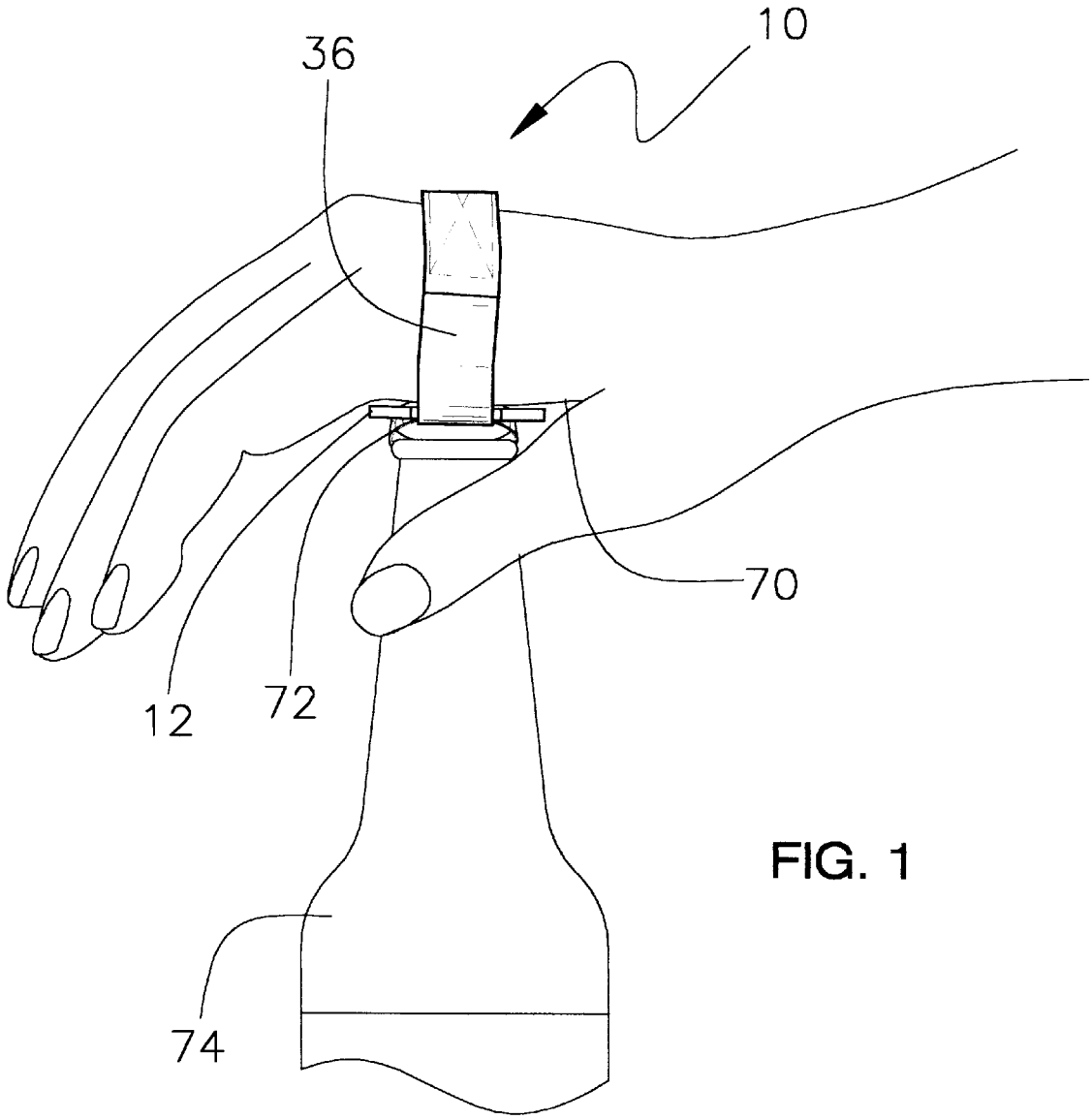
FIG. 1 is a schematic side view of a new bottle opener according to the present invention.
Figure 2:
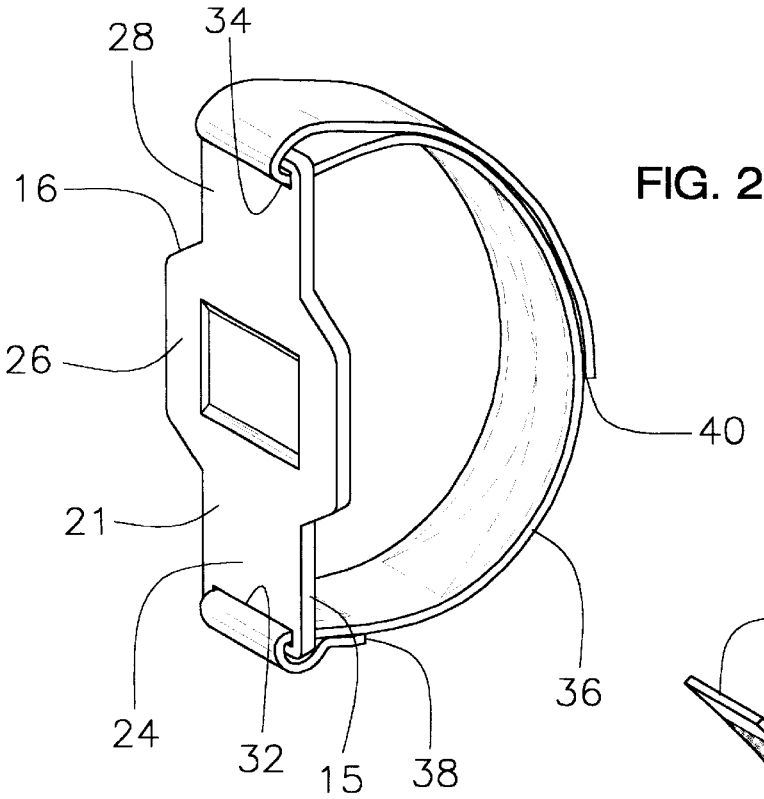
FIG. 2 is a schematic perspective view of the present invention.
Figure 3:
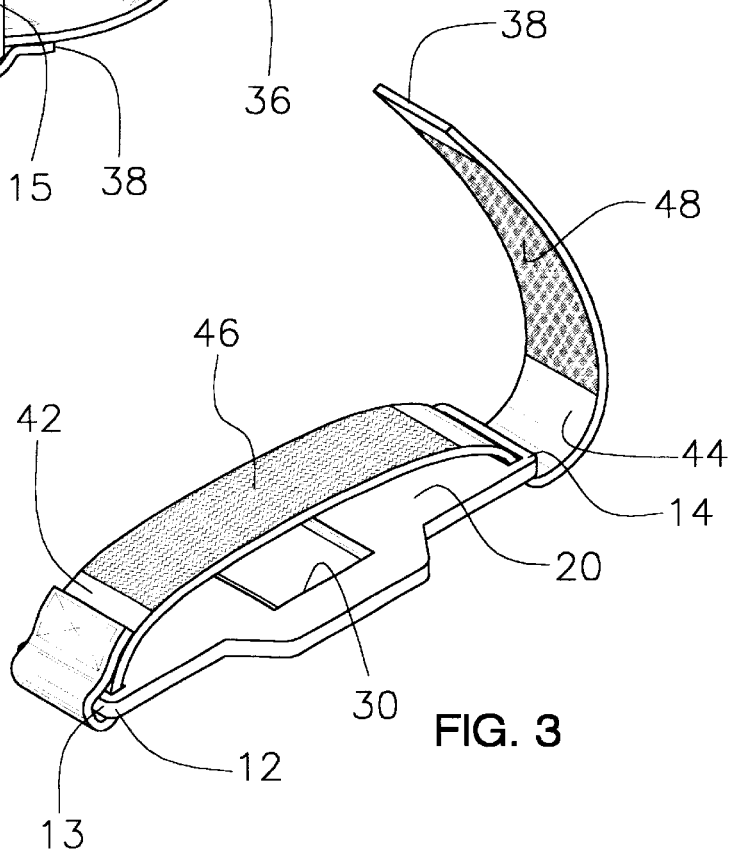
FIG. 3 is a schematic perspective view of the present invention.

With reference now to the drawings, and in particular to FIGS. 1 through 3 thereof, a new bottle opener embodying the principles and concepts of the present invention and generally designated by the reference numeral 10 will be described.

As best illustrated in FIGS. 1 through 3, the bottle opener 10 generally comprises a substantially rigid panel 12 having a first surface 13, a second surface 14, a third surface 15 and a fourth surface 16 wherein the first 13 and second 14 surfaces are opposite surfaces. The third 15 and fourth 16 surfaces each have a length greater than a length of the first 13 and second 14 surfaces. The panel 12 has a first side 21 and a second side 22. The panel 12 has a first portion 24, a middle portion 26 and a second portion 28 wherein the first portion 24 is adjacent to the first surface 13 and the second portion 28 is adjacent to the second surface 14. The panel 12 has a first opening 30 therein positioned in the middle portion 26. The first opening 30 has a generally rectangular shape. As disclosed in FIGS. 2 and 3 of the drawings, it can be seen that the first opening 30 is defined in part by a first beveled edge 50 and second beveled edge 51 that are in opposed relationship to each other. The middle portion 26 has a width from the third surface 15 to the fourth surface 16 greater than a width of the first 24 and second 28 portions. The panel 12 has a second opening 32 therein positioned generally adjacent so the first surface 13. The panel 12 has a third opening 34 therein positioned generally adjacent to the second surface A strap 36 is extendable between the second 32 and third 34 openings. The strap 36 has a first end 38, a second end 40, a first surface 42 and a second surface 44. The first end 38 is extended through the second opening 32 and is attached to the first surface 42 at a point nearer the first end 38 than the second end 40. The second end 40 of the strap 36 is extendable through the third opening 34.

A fastening means removably fastens the first surface to the second surface. The fastening means comprises a hook and loop fastening means including a hook portion 46 and a loop portion 48. The hook portion 46 is attached to the first side 42 of the strap 36 and is positioned nearer the first end 38 than the second end 40. The loop portion 48 is attached to the second side 44 of the strap 36 and is positioned nearer the second end 40 than the first end 38.

In use the first side 21 of the panel 12 is positioned against the palm 70 of a user. The strap 36 is extended around the hand the second end 40 of the strap is extended through the third opening 34 such that the second surface 44 abuts the first surface 42. The first surface 42 is thereby attached to the second surface 44. A bottle cap 72 is positioned in the first opening 30 and the panel 12 is biased against the bottle cap 72 in the manner of using a conventional bottle cap to remove the bottle cap 72 from a bottle 74.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bottle opening device for positioning on the palm of a user, said device comprising:

a substantially rigid panel having a first surface, a second surface, a third surface and a fourth surface wherein said first and second surfaces are opposite surfaces, said third and fourth surfaces having a length greater than a length of said first and second surfaces, said panel having a first side and a second side, said panel having a first portion, a middle portion and a second portion wherein said first portion is adjacent to said first surface and said second portion are adjacent to said second surface, said panel having a first opening therein positioned in said middle portion, said first opening having a generally rectangular shape, said opening having beveled edges adjacent to the third and fourth surfaces of the panel, said middle portion having a width from said third surface to said fourth surface greater than a width of said first and second portions, said panel having a second opening therein positioned generally adjacent so said first surface, said panel having a third opening therein positioned generally adjacent to said second surface;

a strap being extendable between said second and third openings, said strap having a first end, a second end, a first surface and a second surface, said first end being extended through said second opening and being attached to said first surface at a point nearer said first end than said second end, said second end of said strap being extendable through said third opening;

a fastening means for removably fastening said first surface to said second surface, said fastening means comprising a hook and loop fastening means including a hook portion and a loop portion, said hook portion being attached to said first side of said strap and being positioned nearer said first end than said second end, said loop portion being attached to said second side of said strap and being positioned nearer said second end than said first end, wherein said second end of said strap is extended through said third opening and said second surface abutted against said first surface such that said first surface is attached to said second surface; and wherein a bottle cap is positioned in said opening and said panel biased against the bottle cap to remove the bottle cap, said opening and said beveled edges being adapted for removing the bottle cap with a side to side motion.

* * * * *